US011772949B2

(12) United States Patent
Landler et al.

(10) Patent No.: US 11,772,949 B2
(45) Date of Patent: Oct. 3, 2023

(54) DEVICE FOR HOLDING A CONTAINER AND CLOSING DEVICE

(71) Applicant: KRONES AG, Neutraubling (DE)

(72) Inventors: Bruno Landler, Neutraubling (DE); Markus Schoenfelder, Neutraubling (DE)

(73) Assignee: KRONES AG, Neutraubling (DE)

( * ) Notice: Subject to any disclaimer, the term of this patent is extended or adjusted under 35 U.S.C. 154(b) by 354 days.

(21) Appl. No.: 16/721,768

(22) Filed: Dec. 19, 2019

(65) Prior Publication Data

US 2020/0369503 A1 Nov. 26, 2020

(30) Foreign Application Priority Data

May 22, 2019 (DE) ..... 10 2019 113 653.9

(51) Int. Cl.
*B67B 3/20* (2006.01)

(52) U.S. Cl.
CPC ..... *B67B 3/206* (2013.01)

(58) Field of Classification Search
CPC .. B67B 3/20; B67B 3/206; B67B 1/06; B65B 7/2835; B65B 7/2842; B65B 7/28
USPC ..... 53/317, 490, 331.5, 300, 201, 314, 486
See application file for complete search history.

(56) References Cited

U.S. PATENT DOCUMENTS 4,939,890 A 7/1990 Peronek et al.
5,467,527 A * 11/1995 Zanini ..... B67B 3/2033 29/773
2004/0069736 A1 4/2004 Peronek
2005/0284537 A1 12/2005 Hartness et al.
2007/0261369 A1 11/2007 Takahara et al.
2012/0085068 A1* 4/2012 Cirio ..... B67B 3/18 53/317

(Continued)

FOREIGN PATENT DOCUMENTS

CN 101348223 A 1/2009
CN 101878179 A 11/2010

(Continued)

OTHER PUBLICATIONS

Search Report dated Feb. 19, 2020, German patent application 10 2019 113 653.9, 6 pages.

(Continued)

*Primary Examiner* — Valentin Neacsu
*Assistant Examiner* — Mary C Hibbert-Copeland
(74) *Attorney, Agent, or Firm* — Haynes and Boone, LLP

(57) ABSTRACT

A device for holding a container in a container handling machine, for example for holding a support-ring-free bottle for the application of a screw closure, includes a carrier and a holding arrangement arranged on the carrier. The holding arrangement is movable relative to the carrier between a closed position for holding the container and an open position for releasing the container. The holding arrangement includes a collar-shaped support projection for supporting the container on a retaining ring of the container. The collar-shaped support projection includes a support projection region of a first holding arm and a support projection region of a second holding arm. The first holding arm and the second holding arm are arranged on the carrier so as to be pivotable in relation to one another for moving between the open position and the closed position.

20 Claims, 13 Drawing Sheets

(56) References Cited

U.S. PATENT DOCUMENTS

| | | | | |
|---|---|---|---|---|
| 2015/0315002 | A1* | 11/2015 | Landler | B67B 7/28 53/490 |
| 2018/0354765 | A1* | 12/2018 | Schoenfelder | B67B 3/2066 |

FOREIGN PATENT DOCUMENTS

| | | | |
|---|---|---|---|
| CN | 102030182 | A | 4/2011 |
| CN | 104002310 | A | 8/2014 |
| CN | 205204789 | U | 5/2016 |
| CN | 107848786 | A | 3/2018 |
| CN | 207347128 | U | 5/2018 |
| CN | 208008434 | U | 10/2018 |
| DE | 102013105221 | A1 | 11/2014 |
| DE | 10 2014105 907 | | 10/2015 |
| DE | 102016106378 | | 10/2017 |
| EP | 2301867 | | 3/2011 |
| EP | 2380832 | | 10/2011 |
| EP | 2 939 972 | A1 | 11/2015 |
| JP | 2001139094 | A | 5/2001 |
| WO | WO 2009/068633 | | 6/2009 |
| WO | WO 2017/174772 | | 10/2017 |

OTHER PUBLICATIONS

First Office Action dated Jul. 19, 2021 from corresponding Chinese Application No. 202010435929.2, 10 pages.
First Office Action dated Apr. 21, 2023 from corresponding European Application No. 20176000.6, 6 pages.
Extended European Search Report dated Nov. 20, 2020, European Patent Application 20176000.6, 7 pages.

* cited by examiner

DEVICE FOR HOLDING A CONTAINER AND CLOSING DEVICE

CROSS REFERENCE TO RELATED APPLICATIONS

This application claims priority from German Patent Application No. DE 10 2019 113 653.9, filed on May 22, 2019 in the German Patent and Trademark Office, the disclosure of which is incorporated herein by reference in its entirety.

BACKGROUND

Technical Field

The present invention relates to a device for holding a container and to a closing device, in particular to a device for holding a container in a container handling machine, for example for holding a support-ring-free bottle with screw closure by its bottleneck, and to a closure device for closing a filled container by way of a container closure, for example a filled support-ring-free bottle by way of a screw closure.

Related Art

Closing containers filled with the respective fill product, for example by means of a screw closure, is known in beverage filling installations. The screw closure is lowered, in this case, from above by means of a closure head onto the containers to be closed and at the same time is rotated. In this case, the threads of the screw closure move into contact with the threads that are arranged in the mouth region of the container and are complementary to said threads and the screw closure is screwed into the closed position as a result of the application of the rotational movement.

The screw closures can be provided with a so-called tamper-evident band which is typically connected to the actual screw closure via thin material bridges and which is realized such that it tears off the actual screw closure when the screw closure is opened for the first time. In this way, a consumer can establish whether the beverage container he has acquired is intact or whether it has already been opened once. The tamper-evident band interacts with a retaining ring of the container for this purpose, the tamper-evident band extending beyond the retaining ring in the direction of the bottom of the container and the material bridges being situated, in this case, substantially at the height of the retaining ring.

In conventional beverage filling installations, containers which are to be closed by way of a screw closure include a carrier ring in the neck region of the container below the retaining ring. The container is gripped, in this case, in the neck region below the carrier ring, the container resting by way of its carrier ring on the correspondingly realized gripping device, for example a clamp.

In order to counter the torque which is exerted as a result of screwing the container closure onto the container, the carrier ring is usually held in a neck guide by way of a so-called spike plate, the spike plate including upwardly directed mandrels or spikes which engage from below in the carrier ring of the container in order to support the torque applied via the closing head and consequently to make it possible in the first place for the container closure to be screwed onto the container. Depending on the design of the carrier ring/carrier ring region, the spikes can also point inwardly upward or inwardly. A realization without spikes is also possible for there are also "screw closures" which are only pressed on.

In order, after a successful closing operation, to remove the containers, then provided with the screw closure, out of the neck guide and to supply them to downstream production steps, in conventional beverage filling installations the containers are raised upward out of the mandrels of the neck guides via a ramp rail. In this case, the containers move by way of their carrier rings onto a fixed ramp rail in order to disengage the carrier rings from the mandrels and thus to enable the filled and now closed containers to be transferred to a following processing station, for example via an outlet star.

In addition, devices are known where below the receiving means for the carrier ring a spike plate is movable between an engagement position of the mandrels and an open position where the spike plate is pivoted downward. Such a device can be found, for example, in WO 2009/068633 A1. So that when the spike plate is moved into the open position it does not collide with the container, the container has to include a comparatively long, substantially cylindrical portion of the neck region below its carrier ring.

A new generation of containers do not include a carrier ring. Said containers are also called support-ring-free bottles. Said support-ring-free bottles only include a retaining ring, with which the tamper-evident band of a screw closure can interact such that the tamper-evident function continues to be maintained. The advantage of support-ring-free bottles consists in the material saving in relation to containers with a carrier ring. On account of the lack of the carrier ring, handling with a rigid spike plate in said region is no longer possible as the closure and in particular the retaining band surrounds the retaining ring substantially completely. In other words, the retaining ring is no longer freely accessible when the screw closure has been applied but is covered by the retaining band. Lifting the filled and closed bottles out by means of a known fixed ramp rail can result here in the tamper-evident band, which then comes into contact with the ramp rail, becoming worn or damaged or even tearing.

For the handling of support-ring-free bottles, in particular the holding of a support-ring-free bottle during the closing by way of a container closure, devices are known correspondingly which include a carrier and a holding arrangement arranged on said carrier, the holding arrangement including a collar-shaped support projection for supporting the container on a retaining ring of the container. Such a device is disclosed, for example, in DE 10 2014105 907 A1. The support projection is realized in such a manner that it can contact the retaining ring of the container from below and radially within the tamper-evident band of the applied container closure and as a result can hold the container directly even when the container closure has been applied. Lifting fingers, which are movable parallel to the container axis and by means of which the container can be raised upward from the support projection, are provided in order to ensure the container is raised and lowered relative to the support projection. The lifting fingers come into contact, in this case, with the tamper-evident band of the applied container closure.

In order to make it possible to handle such support-ring-free bottles, on their neck region below the retaining ring they include a comparatively long cylindrical or slightly conical portion which enables the corresponding raising and lowering of the lifting fingers. For reasons of further material saving, of the overall visual impression of the container and the applied container closure, and of improved tamper protection of the tamper-evident band from below the container closure, the portion of the neck region in the case of new generation support-ring-free bottles is significantly shortened. In the case of support-ring-free bottles which are realized in such a manner, it is no longer possible to provide the travel between support projection and container as a result of raising and lowering them parallel to the container axis, which is necessary when using conventional holding arrangements as the respective installation components would then hit the shoulder region of the container.

SUMMARY

An improved device for holding a container in a container handling machine, for example for holding a support-ring-free bottle for the application of a screw closure, as well as a closing device for closing a filled container by way of a container closure, for example for closing a support-ring-free bottle by way of a screw closure, are described.

In particular, a device for holding a container in a container handling machine, for example for holding a support-ring-free bottle for the application of a screw closure, is provided.

Correspondingly proposed is a device for holding a container in a container handling machine, for example for holding a support-ring-free bottle for the application of a screw closure, including a carrier and a holding arrangement arranged on the carrier, wherein the holding arrangement is movable relative to the carrier between a closed position for holding the container and an open position for releasing the container, wherein the holding arrangement includes a collar-shaped support projection for supporting the container on a retaining ring of the container, wherein the collar-shaped support projection includes a support projection region of a first holding arm and a support projection region of a second holding arm. The first holding arm and the second holding arm are arranged on the carrier so as to be pivotable in relation to one another for moving between the open position and the closed position.

By the holding arrangement including a first holding arm with a support projection region and a second holding arm with a further support projection region, the first holding arm and the second holding arm being arranged on the carrier so as to be pivotable in relation to one another, less space is required for pivoting the support projection regions between the closed position and the open position perpendicularly to the container axis of a container to be held. As a result of the device realized in such a manner, it is also correspondingly possible to receive and to release again containers that include a comparatively short, substantially cylindrical neck region for handling purposes below their retaining ring.

In particular, such containers can be held by the device during and following the closing of the containers by way of a container closure without collisions occurring between the parts of the device and the container or the container closure, in particular the tamper-evident band thereof. The device therefore enables the processing of the latest support-ring-free bottles, for example in automated filling installations.

In some embodiments, the support projection predefines a holding plane on which a retaining ring of a held container rests in the closed position, the holding plane realizing a lower height in the open position than in the closed position.

In other words, when the device is moved into the open position, the support projection is moved downward and at the same time also radially outward as a result of the pivoting movement so that a latest generation support-ring-free bottle can be received and, once the support projection has been transferred into the closed position, held by the device, a container closure can then be applied and the support projection, in this case, is not in the way as it is arranged radially within the container closure and consequently also radially within a tamper-evident band of the container closure. When the device is then opened, the support projection is then moved downward and outward out of engagement with the container and the container closure.

According to various embodiments, the support projection predefines a holding plane, wherein the first holding arm is arranged on the carrier so as to be pivotable about a first pivot axis and the second holding arm is arranged on the carrier so as to be pivotable about a second pivot axis, wherein the first pivot axis and the second pivot axis lie in a pivot axis plane which extends parallel to the holding plane.

This makes it possible to pivot the holding arms and, in particular, the support projection regions downward and, in particular, outward when pivoting from the closed position into the open position so that the space available for the container is increased compared to conventional devices in particular in the neck region of the container held in the closed position. In addition, the support projection regions can be pivoted, as a result, from outside and below out of the open position moving within the position of the tamper-evident band of the container closure applied to the container in order to move into contact with the retaining ring of the container.

In certain embodiments, the holding arms are realized so as to be pivotable between the closed position and the open position, wherein the support projection regions are pivoted downward and radially outward about the respective pivot axis in the open position relative to their position in the closed position. As a result, the support projection regions are also pivoted in particular radially outward relative to their position in the closed position when the device is opened such that an enlarged space or installation space is available for the container below the retaining ring.

In order to be able to provide, in addition to holding the container, a device preventing rotation of the container about the longitudinal axis thereof in the closed position, the support projection can include at least one tapered mandrel for impeding rotation of a container received by the holding arms about its container axis. In several embodiments, each of the support projection regions includes, in this case, at least one tapered mandrel. In one embodiment, the tapered mandrel lies, in this case, in an extension of the support projection region. In various embodiments, the at least one mandrel is directed upward in the closed position. As an alternative to this, at least one mandrel can also be directed inwardly upward or inwardly.

In particular, when the device for holding a container is provided in a closing machine, the afore-described anti-rotation device can ensure that when a container closure is screwed onto the container, the container held in the device is not rotated by the rotational movement of the container closure, which would conflict with secure closing of the container.

When the pivot axis plane according to a further embodiment is arranged above the holding plane, a movement component in the axial direction, therefore perpendicular to the pivot axis plane, can be reduced in relation to a movement component in the radial direction with reference to the container axis of a movement path along which the lifting arms and in particular the support projection regions are moved when pivoting between the closed position and the open position. In other words, the movement path, when seen perpendicularly to the pivot axis plane, can be realized in a flatter manner. As a result, a container held by the device has available to it below the holding plane a larger installation space in which it is able to extend without colliding with parts of the device.

A particularly compact design of the device can be achieved when the pivot axis plane is arranged at the height of the holding plane.

According to a further embodiment, there is provided at least one third holding arm which is pivotable about a third pivot axis relative to the carrier. As a result, the aforenamed effects may be provided in an even more pronounced manner.

When the support projection of a further embodiment extends correspondingly at a circumferential angle of less than or equal to 180°, a container to be held can be transferred to the device and removed when the holding arms are in the closed position; the device is therefore closed.

According to an alternative embodiment, the support projection extends at a circumferential angle of more than 180°. As a result, the container can be prevented from slipping out at the side in the closed position. In addition, a distribution of force of the weight force or of a force introduced from outside, for example of an axial component of a closing force, can be transmitted to the device in a more evenly distributed manner as the circumferential angle at which the support projection extends increases.

In order to increase the variability of the device further, there can be provided at least two pivot axis planes which are arranged spaced apart from one another, wherein at least one pivot axis lies in a first pivot axis plane and a further pivot axis lies in a second pivot axis plane. In addition, a more compact design of the device, in particular, can also be achieved as a result.

According to a further embodiment, the support projection is realized in such a manner that the container is supported exclusively on the bottom side of the retaining ring by the support projection. In other words, the support projection is realized in such a manner that said latter is not in substantially force-transmitting contact with a tamper-evident band of an applied container closure when a container, closed by way of a container closure, is held by the device in the closed position.

In some embodiments, the support projection is realized, in this case, in such a manner that in the region of the tamper-evident band the support projection includes an outside diameter which is smaller than an inside diameter of the tamper-evident band. In addition, the support projection may have an inside diameter which is greater than an outside diameter or an outside contour of the container at the height of the tamper-evident band.

According to a further embodiment, a bearing portion is arranged on the carrier for supporting the container on the retaining ring or on the tamper-evident band of an applied container closure when the holding arms are pivoted into the open position. As a result, on the one hand, pre-positioning of a container to be held can be provided when the device is open. Furthermore, a container closed by way of a container closure can be prevented from being released in an uncontrolled manner once the device has been opened, therefore once the holding arms have been pivoted from the closed position into the open position. In addition, as an option the mandrel can also be released from the retaining ring as a result.

The bearing portion is arranged in some embodiments at a predefined distance below the holding plane, wherein the distance is realized in a manner such that, with the holding arms in the closed position, the applied container closure is spaced from the bearing portion, at a distance of between 0.1 and 2 mm, for example between 0.3 and 1 mm, such as 0.5 mm. This ensures that the bearing portion does not cause any damage to the container closure or prevent closure of the container whilst the container is held by the holding arms.

In order to be able to predefine the position of the holding arms in a targeted manner, a control unit can be provided for controlling the position of the holding arms, wherein the control unit includes, in certain embodiments, a cam follower and/or a drive, and in some embodiments, a motor. The control unit can be realized to interact with a correspondingly realized guide element, for example a lifting cam or a groove path, via at least one roller. In addition, the control unit can include a prestressing element which prestresses the control unit into a predefined position, for example the closed position or the open position.

A closing device for closing a filled container by way of a container closure, for example a support-ring-free bottle by way of a screw closure, is also provided.

Correspondingly proposed is a closing device for closing a filled container by way of a container closure, such as a support-ring-free bottle by way of a screw closure, including a closing member for the application of a container closure onto a filled container and a device for holding a container according to one of the preceding embodiments.

The advantages and effects described with regard to the device for holding a container can be achieved in an analogous manner by the closing device.

BRIEF DESCRIPTION OF THE FIGURES

Further embodiments of the invention are explained in more detail by the following description of the figures.

DETAILED DESCRIPTION

Exemplary embodiments are described below by way of the figures. In this case, identical, similar or similarly acting elements in the different figures are provided with identical reference symbols and repeated description of said elements is waived in part to avoid redundancies.

Figure 1:
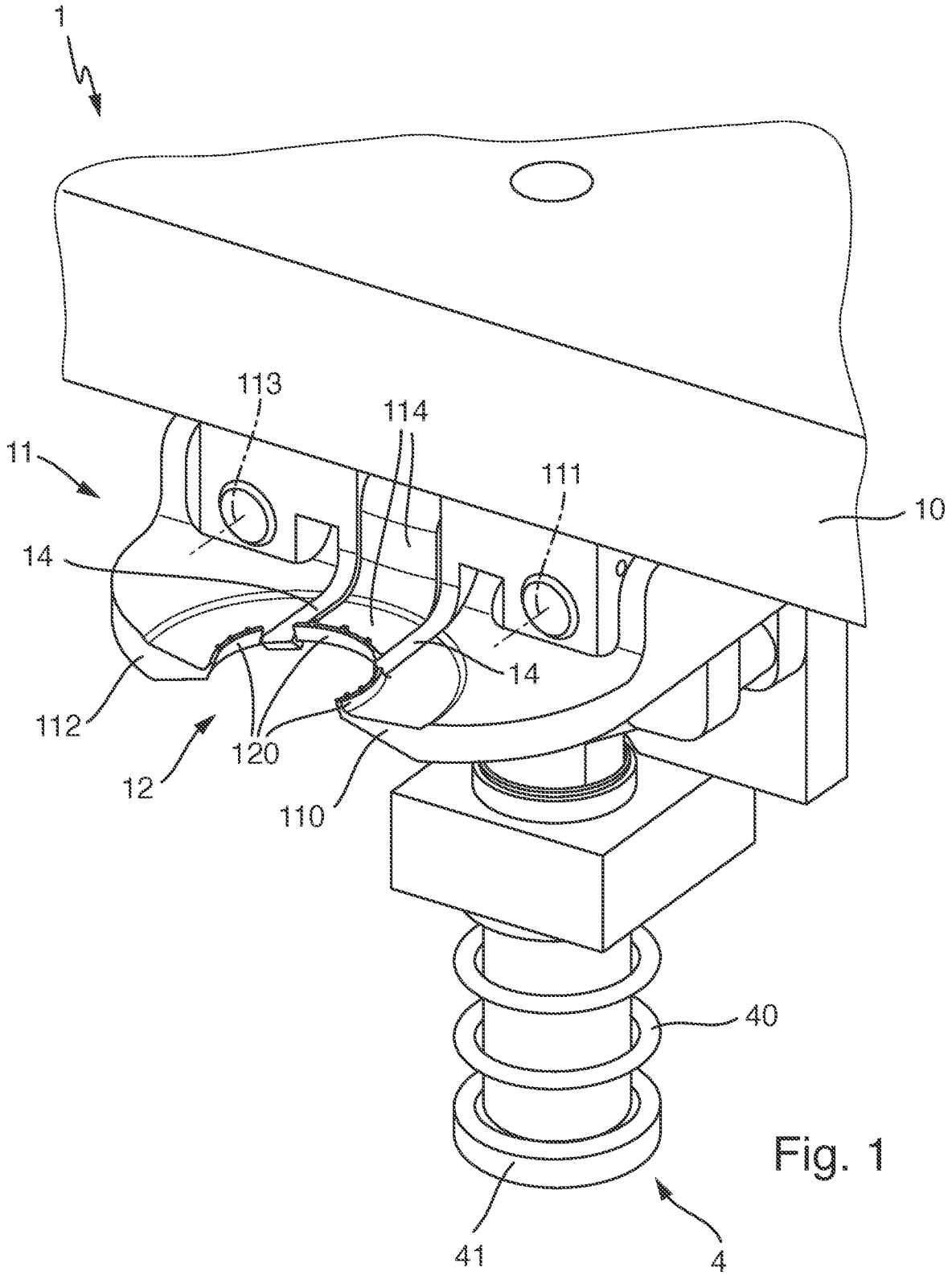
FIG. 1 is a schematic representation of a perspective side view of a device for holding a container in a container handling machine in a closed state.

FIG. 1 shows a schematic representation of a perspective side view of a device 1 for holding a container 2 (see FIG. 5) in a container handling machine in a closed state. The device 1 is realized in the present case for holding a support-ring-free bottle by its bottleneck and serves to hold the support-ring-free bottle for the application of a screw closure.

The device 1 includes a carrier 10 and a holding arrangement 11 which is arranged on the carrier 10. The holding arrangement 11 is movable relative to the carrier 10 between a closed position, which corresponds to the closed state of the device 1, and an open position, which corresponds to an open state of the device 1. For supporting the container on a retaining ring of the container, the holding arrangement 11 includes a collar-shaped support projection 12 which extends upward.

The support projection 12 is also realized upwardly in a tapered manner but can also assume another form.

The holding arrangement 11 includes a plurality of holding arms 110, 112, 114, which are arranged on the carrier 10 so as to be pivotable in relation to one another. In this case, a first holding arm 110 is arranged on the carrier 10 so as to be pivotable about a first pivot axis 111, a second holding arm 112 is arranged on the carrier 10 so as to be pivotable about a second pivot axis 113, and a third holding arm 114 is arranged on the carrier 10 so as to be pivotable about a third pivot axis 115 (not shown here).

Here, the support projection 12 includes three support projection regions 120, each of the holding arms 110, 112, 114 including a support projection region 120. In other words, the support projection regions 120 together realize the support projection 12.

In order to be able to predefine the position of the holding arms 110, 112, 114, they are connected in articulated manner to a control unit 4 to control the position of the holding arms 110, 112, 114. The control unit 4 includes a cam follower 41 which is prestressed by a prestressing element 40 in the form of a spring in such a manner that the holding arms 110, 112, 114 are prestressed into the closed position. The control unit 4 can interact via the cam follower 41 with a correspondingly realized guide element of a handling machine, for example a lifting cam or a groove path, the guide element predefining the position of the holding arms 110, 112, 114 as a result of the interaction with the cam follower 41.

The control unit 4 can also follow a guide path in a contactless manner, for example via magnets or an electric, electromagnetic, pneumatic or hydraulic actuator.

Figure 2:
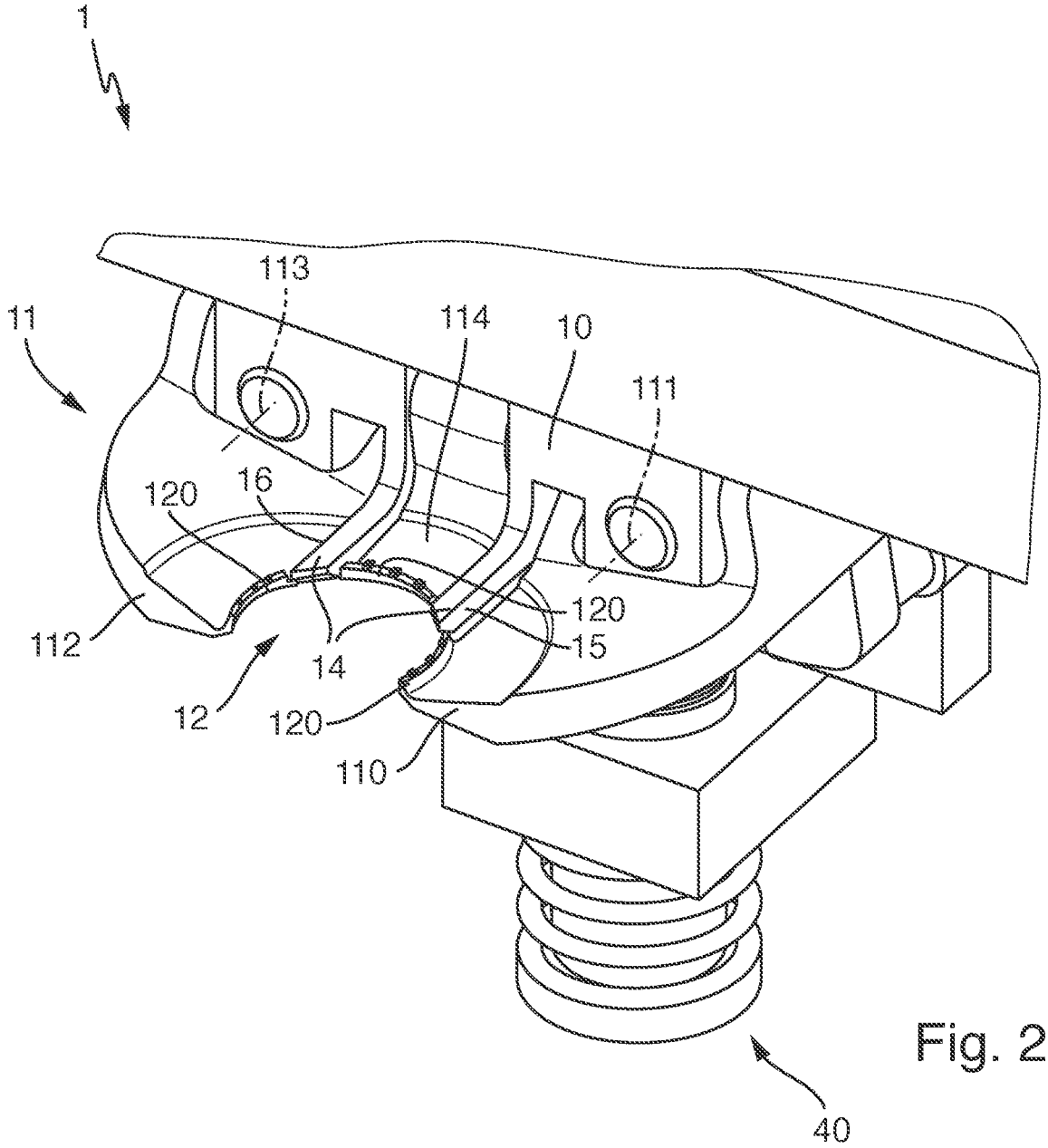
FIG. 2 is a schematic representation of a perspective side view of the device from FIG. 1 in an open state.

FIG. 2 shows a schematic representation of a perspective side view of the device 1 from FIG. 1 in an open state. As can be seen in a comparison with FIG. 1, the support projection 12 or the support projection regions 120 in the open position, as shown in FIG. 2, are at a lower height compared to the closed position as can be seen in FIG. 1. This is obtained as a result of the support projection regions 120, in the open position, being pivoted downward and radially outward relative to their position in the closed position by pivoting the holding arms 110, 112, 114 about their respective pivot axis 111, 113, 115.

As can be seen from FIGS. 1 and 2, the device 1 additionally includes two bearing portions 14 on the carrier 10 for supporting the container on its retaining ring or on the tamper-evident band of an applied container closure when the holding arms 110, 112, 114 are pivoted into the open position.

As can be seen in FIG. 1 in conjunction with FIG. 2, a stop 15, 16, which predefines the position of the aforenamed holding arms 110, 112 in the closed position, is provided in each case by the respective outside surface of the bearing portions 14 for the first holding arm 110 and the second holding arm 112.

Figure 3:
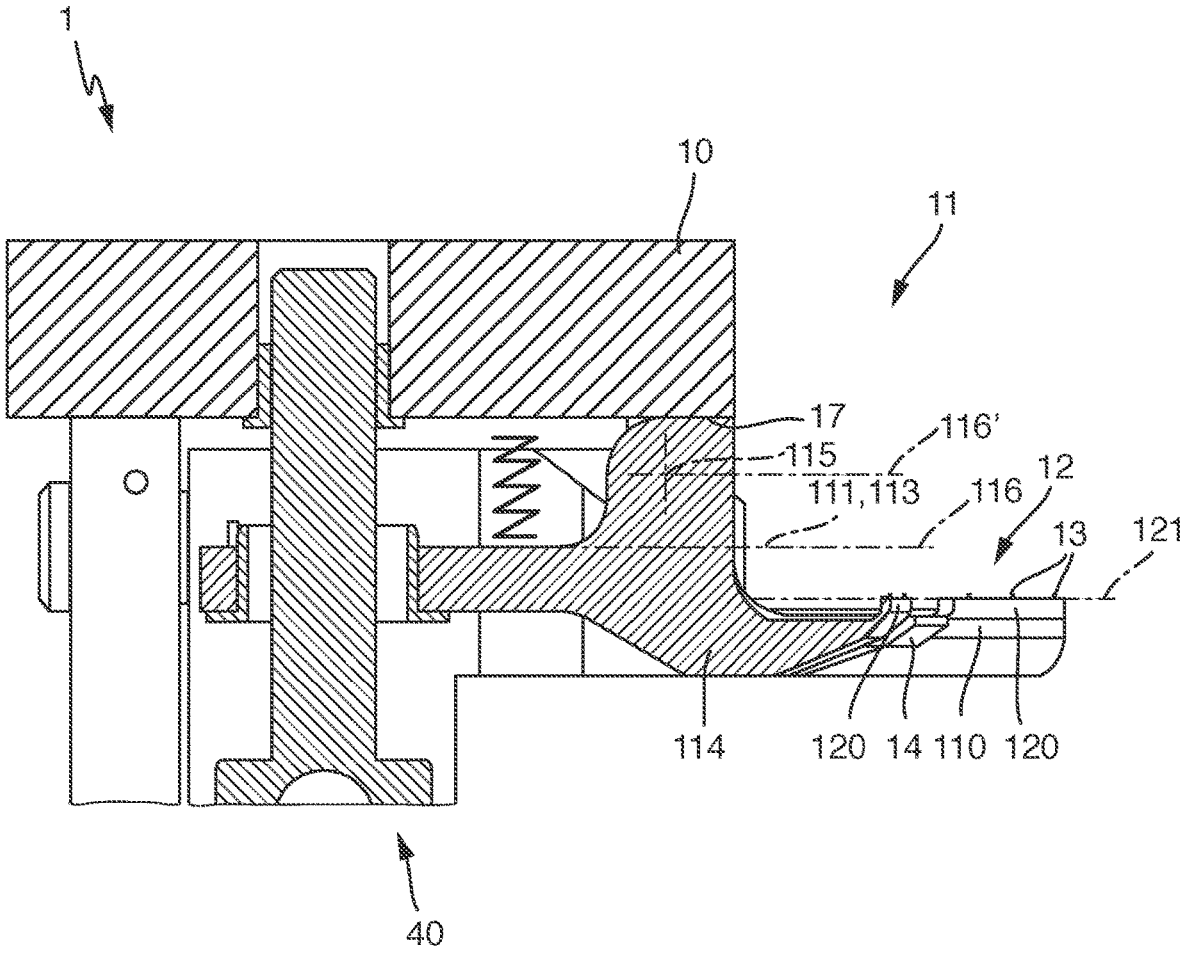
FIG. 3 is a schematic representation of a sectional view through the device from FIG. 1.

FIG. 3 shows a schematic representation of a lateral sectional view through the device 1 from FIG. 1. The support projection 12 or the support projection regions 120 predefine a holding plane 121 which extends substantially perpendicularly to gravity, therefore horizontally.

The first pivot axis 111 and the second pivot axis 113 lie in a first pivot axis plane 116 which extends parallel to the holding plane 121. The third pivot axis 115 lies in a further pivot axis plane 116', which is also arranged above the holding plane 121 and parallel to the same at a spacing from the first pivot axis plane 116.

The support projection 12 additionally includes a plurality of tapered mandrels 13 for impeding rotation of a container received by the holding arms 110, 112, 114 about its container axis. The mandrels 113 are distributed at regular intervals along the support projection 12 and extend over each of the support projection regions 120.

As an alternative to this, all pivot axes 111, 113, 115 can also lie on different pivot axis planes or on one common pivot axis plane.

As can be seen in said view, on the top side of the third holding arm 114 the carrier 10 provides a stop 17 which predefines the position of the third holding arm 114 in the closed position.

The bearing portions 14 are arranged at a predefined distance below the holding plane 121, the distance being realized in such a manner that with the holding arms 110, 112, 114 in the closed position, the applied container closure is at a spacing from the bearing portions 14, in the present case at a distance of approximately 0.5 mm.

Figure 4:
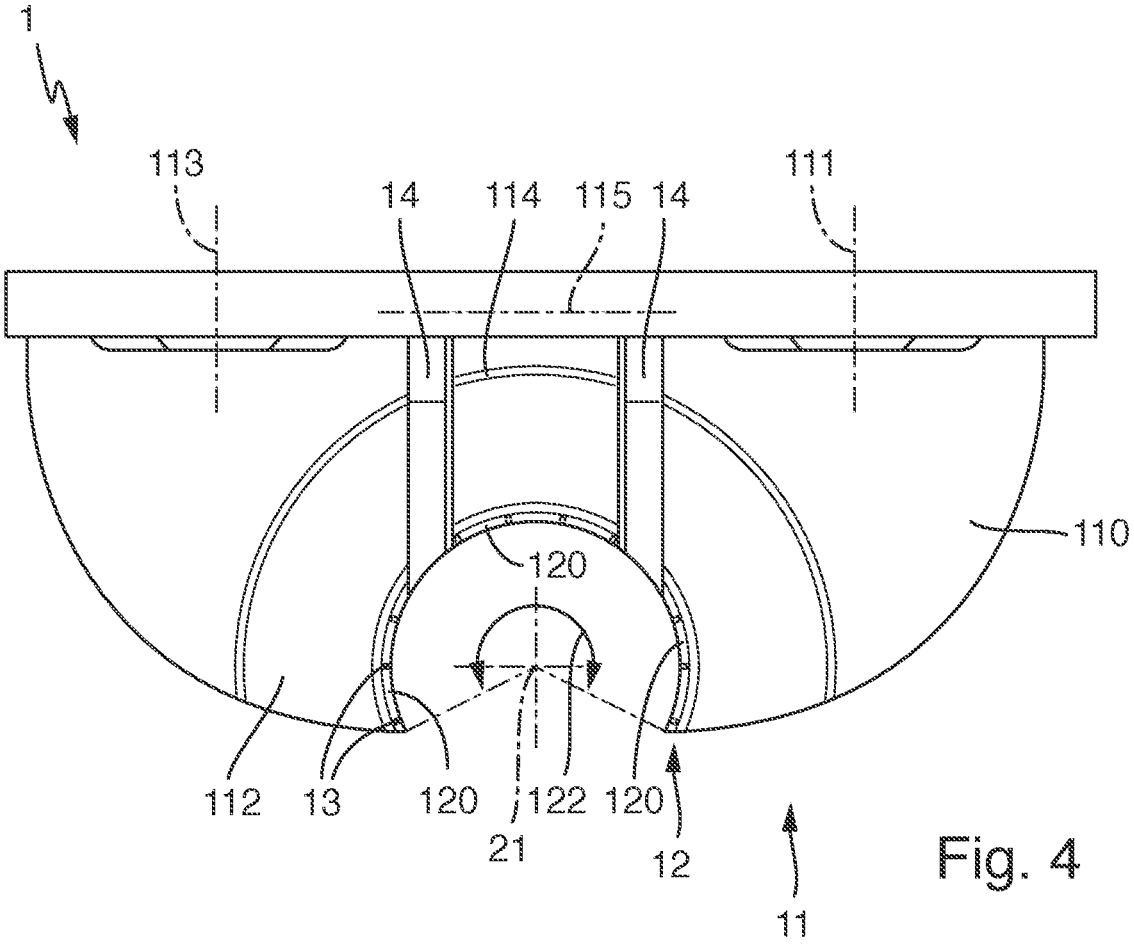
FIG. 4 is a schematic representation of a top view of the device from FIG. 1.

FIG. 4 shows a schematic representation of a top view of the device 1 from FIG. 1. The pivot axes 111, 113 are arranged parallel to one another, whereas the third pivot axis 115 runs perpendicularly to the first pivot axis 111 and to the second pivot axis 113. As a result of said arrangement, the first holding arm 110 and the second holding arm 112 realize two lateral holding arms, and the third holding arm 114 realizes a central holding arm of the device 1.

It can be clearly seen here that the support projection 12 divides into the support projection regions 120. Each of the support projection regions 120 includes a plurality of mandrels 13. The support projection 12 is arranged substantially on a divided circle about a central axis which corresponds to the container axis 21 of a container received in the device.

It can additionally be seen that the support projection 12 extends at a circumferential angle 122 of more than 180°, in the present case approximately 225°. As an alternative to this, the circumferential angle 122 can also include another value.

Figure 5:
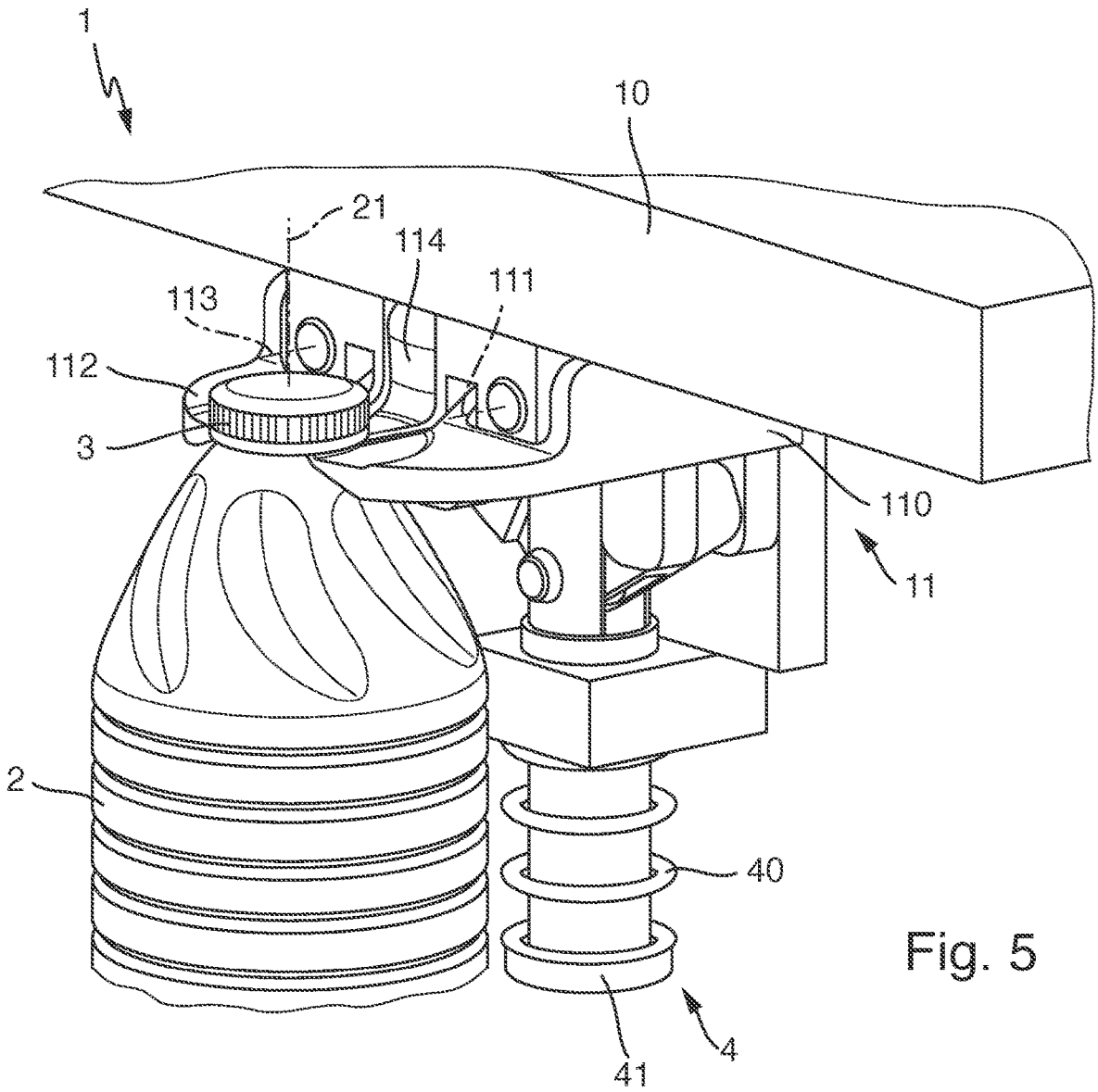
FIG. 5 is a schematic representation of a perspective side view of the device from FIG. 1 with a container held by the device.

FIG. 5 shows a schematic representation of a perspective side view of the device 1 from FIG. 1 with a container 2 in the form of a support-ring-free bottle held by the device 1, onto which a container closure 3 has already been screwed.

The holding arms 110, 112, 114 and the support projection regions 120 thereof are realized in such a manner that the container 2 is supported by the support projection 12 exclusively on the bottom of the retaining ring of the container 2, which is hidden here by the container closure 3.

By the support projection 12 extending in the holding plane 121, and the retaining ring of the container 2 extending perpendicularly to the container axis 21, the container 2 is held in such a manner by the holding arms 110, 112, 114 that the container axis 21 is oriented perpendicularly to the holding plane 121.

Figure 6:
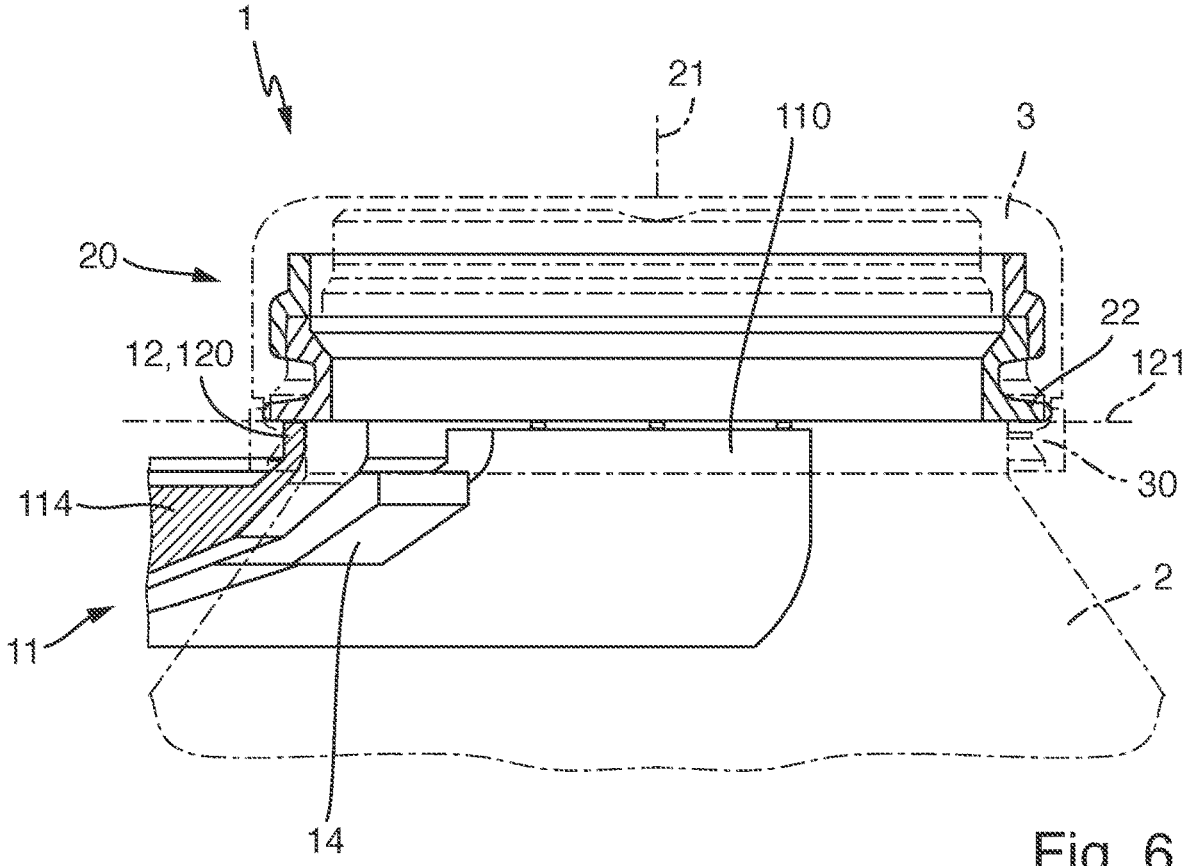
FIG. 6 is a schematic representation of a sectional view through a neck region of the container from FIG. 5.

FIG. 6 shows a schematic representation of a sectional view through a neck region 20 of the container 2 from FIG. 5. It can be seen here that the support region 12 extends radially inward and upward from the holding arms 110, 112, 114 with reference to the container axis 21 such that it engages under the tamper-evident band 30 of the container closure 3 without, in this case, absorbing part of the weight force of the container 3 via the tamper-evident band. To this end, the support region 12 is realized in such a manner that in the closed position as shown in FIG. 6, it is at a distance from the tamper-evident band 30 of the container closure 3 applied to the container 2 when the container 2 is held in the device 1 as provided.

Consequently, the container 2 is supported on the device 1 with its retaining ring 22 substantially exclusively via the support projection 12. The container 2 lies therefore with substantially its entire weight force on the support projection 12.

Figure 7:
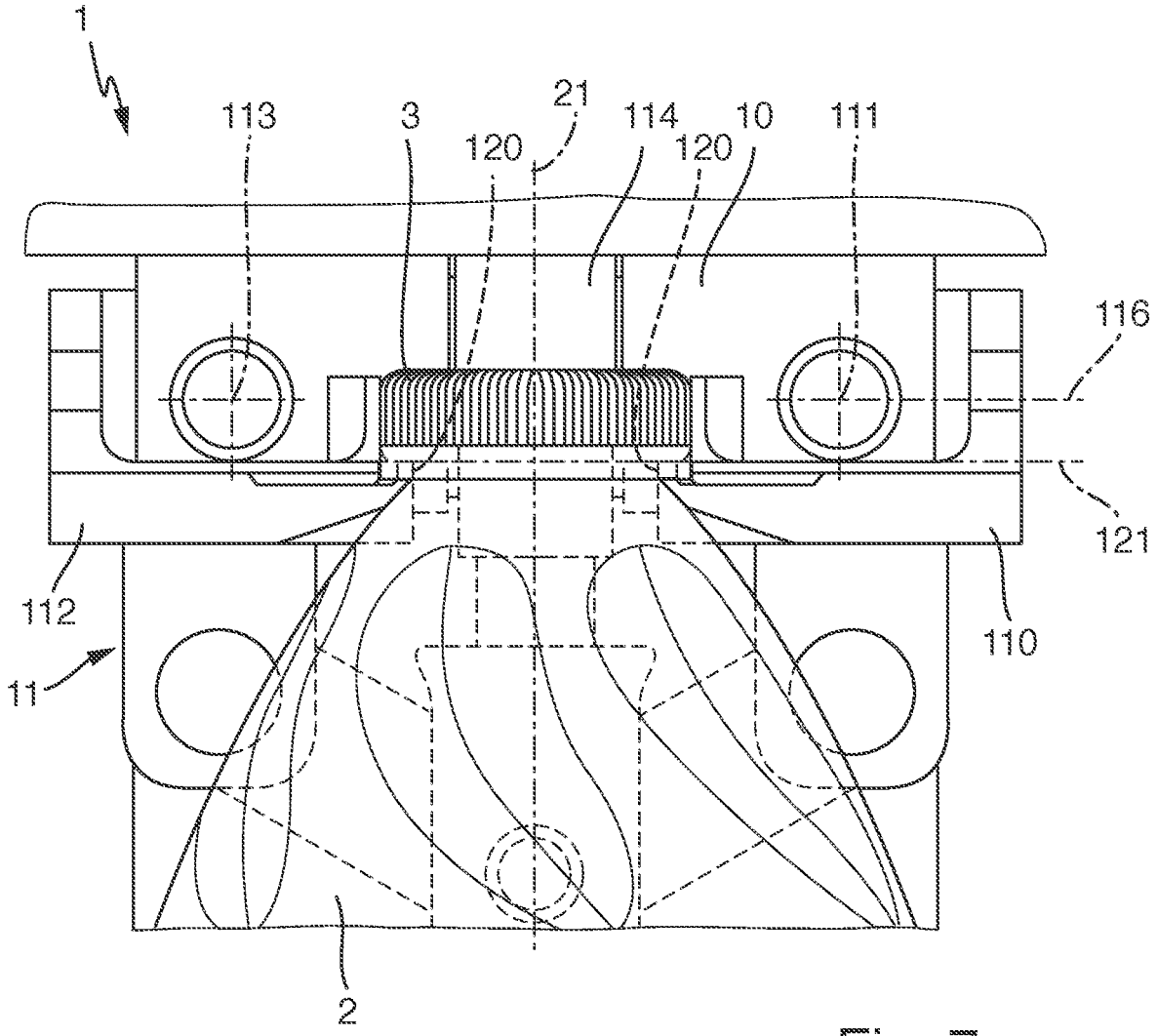
FIG. 7 is a schematic representation of a view of a detail of the device from FIG. 5.
Figure 8:
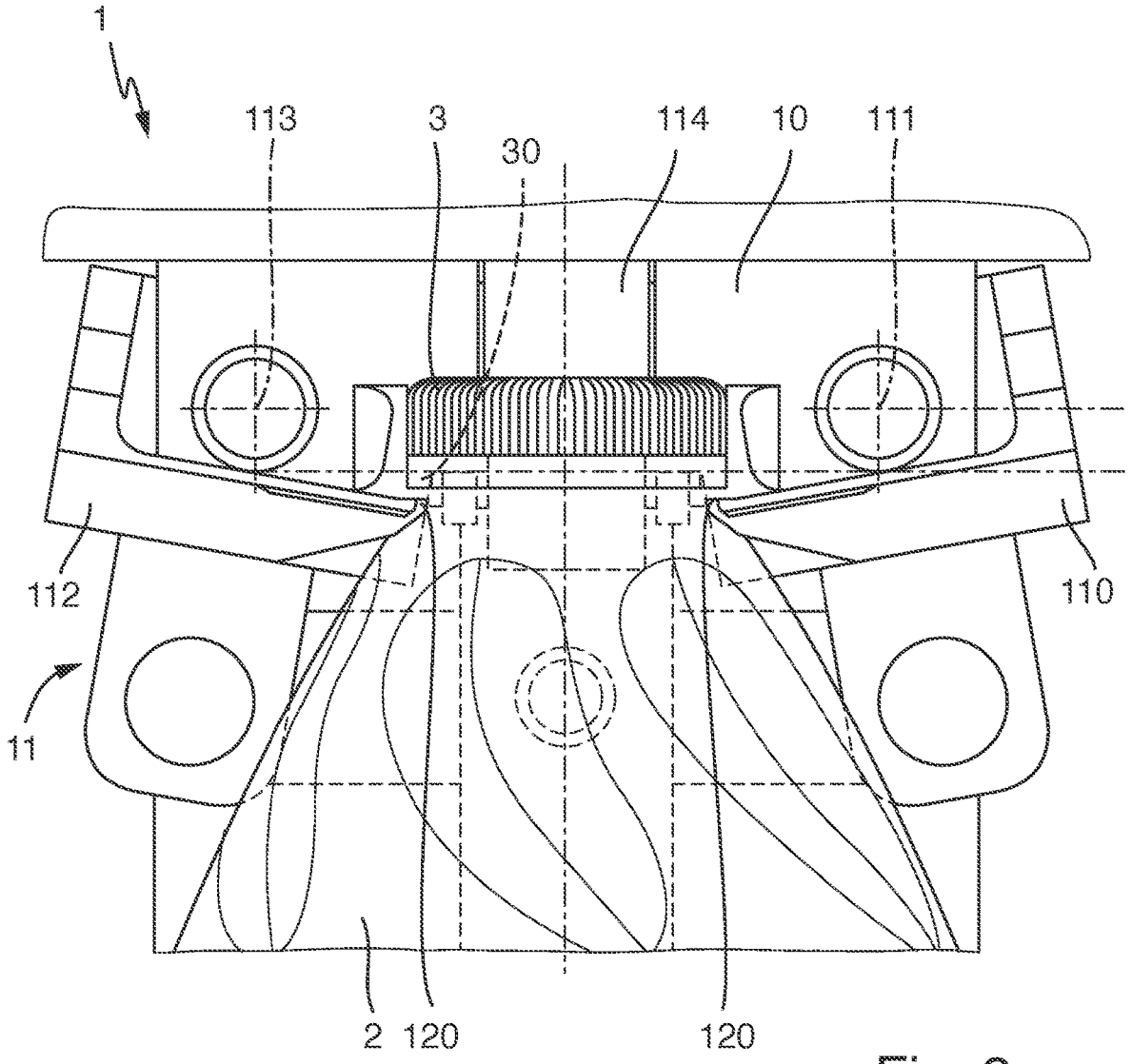
FIG. 8 is a schematic representation of a view of a detail of the device from FIG. 5 in an open state.

FIG. 7 shows a schematic representation of a view of a detail of the device 1 from FIG. 5, the device 1 being closed. In comparison, FIG. 8 shows a schematic representation of a view of a detail of the device 1 from FIG. 5 in a now open state. In the position of the holding arms 110, 112, 114 which is shown in FIG. 7, which holding arms are situated in the closed position, the container 2 is held as described above by the support projection 12.

It can also be seen from the two FIGS. 7 and 8 that the height realized by the support projection 12, which includes the support projection regions 120, is lower in the open position which is shown in FIG. 8 than the height in the closed position which is shown in FIG. 7. In other words, the height realized by the support projection 12 is lowered as a result of the pivoting of the holding arms 110, 112 relative to one another when the device 1 is opened.

In the open position of the holding arms 110, 112, 114 shown in FIG. 8, the support projection 12 is or each of the individual support projection regions 120 are—as already described—pivoted downward and radially outward in such a manner that the container 2 then rests on the bearing portions 14 (see FIGS. 1 and 2), the container 2 being supported on the bearing portions 14 via the tamper-evident band 30 of the applied container closure 3.

Consequently, the container 2 and the support projection 12 or the support projection regions 120 are disengaged.

Figure 9:
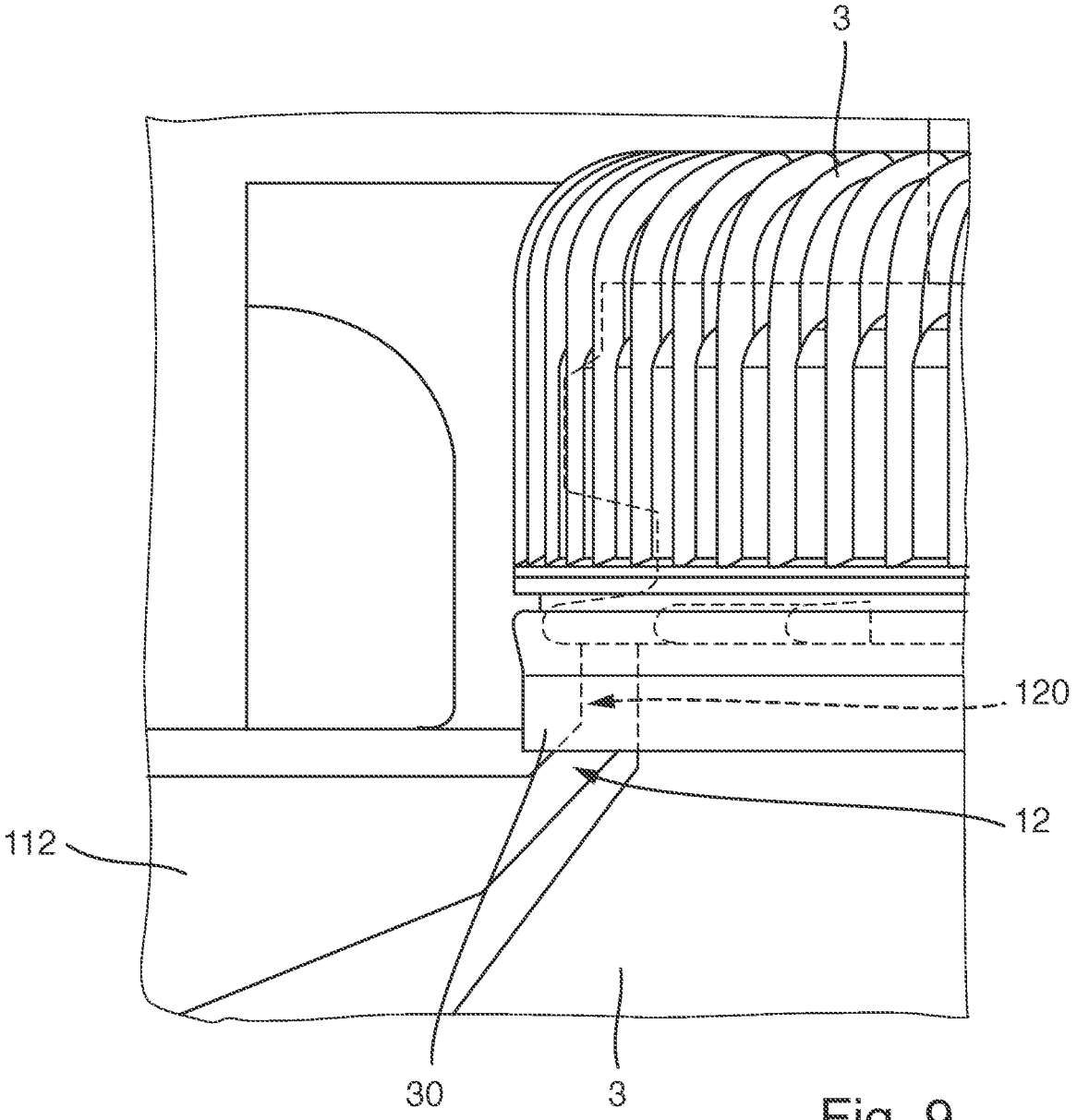
FIG. 9 is a schematic representation of a view of a detail of a support region of the device from FIG. 5 holding the container.
Figure 10:
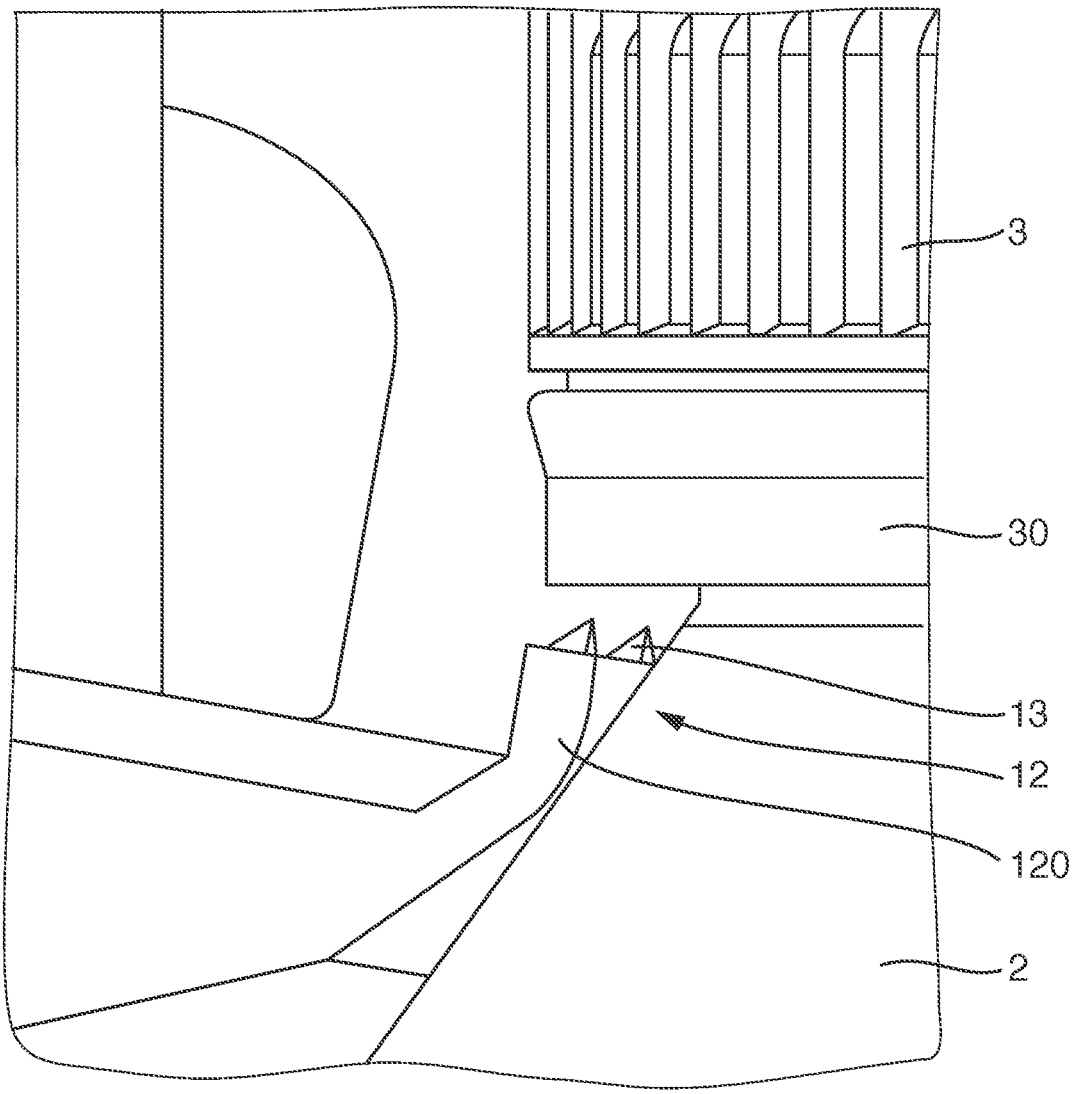
FIG. 10 is a schematic representation of a view of the detail from FIG. 9 with the device in an open state.

FIG. 9 shows a schematic representation of a view of a detail of a support projection 12 of the device 1 from FIG. 5 holding the container 2 and FIG. 10 shows a schematic representation of a view of a detail of the device 1 from FIG. 5 with the device 1 in the open state. FIGS. 9 and 10 show therefore in detail what is described in FIGS. 7 and 8. In addition, the mandrels 13, which are embedded in the material of the retaining ring 22 of the container 2 and, as a result, are able to support correspondingly the torque input into the container 2 by a screw capper, can be seen in detail in FIG. 10.

By the holding arms 110, 112, 114 provided with the support projection regions 120 being pivoted downward and radially outward with reference to the container 2 in the open position and as a result being spaced from the container 2, a sufficiently large opening is provided in order to be able to remove the container 2 out of the device 1 on the open side of the device 1.

In addition, a collision between the holding arms 110, 112, 114 and the container 2 and in particular a shoulder region of the container 2 does not occur.

Figure 11:
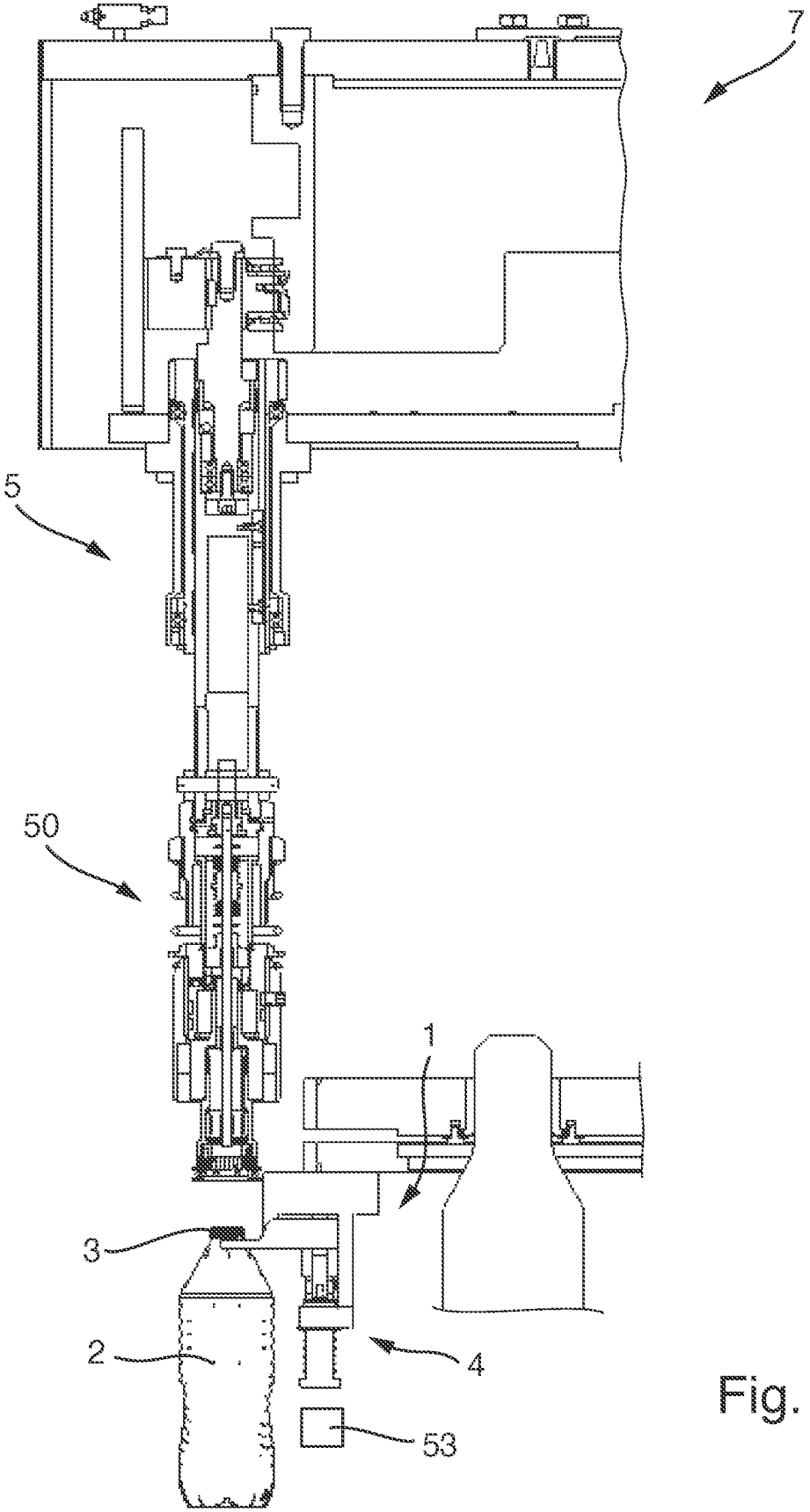
FIG. 11 is a schematic representation of a sectional view of a closing device for closing a container by way of a container closure.

FIG. 11 shows a schematic representation of a sectional view of a closing device 5 for closing a container 2 by way of a container closure 3. The closing device 5 includes a device 1 according to FIG. 1 and a closing member 50 arranged above the device 1 for the application of a container closure 3 onto a filled container 2. The control unit 4 interacts with a guide element 53 for controlling the position of the holding arms 110, 112, 114.

The closing device 5 is arranged on a capper carousel 7 in a rotary design.

Figure 12:
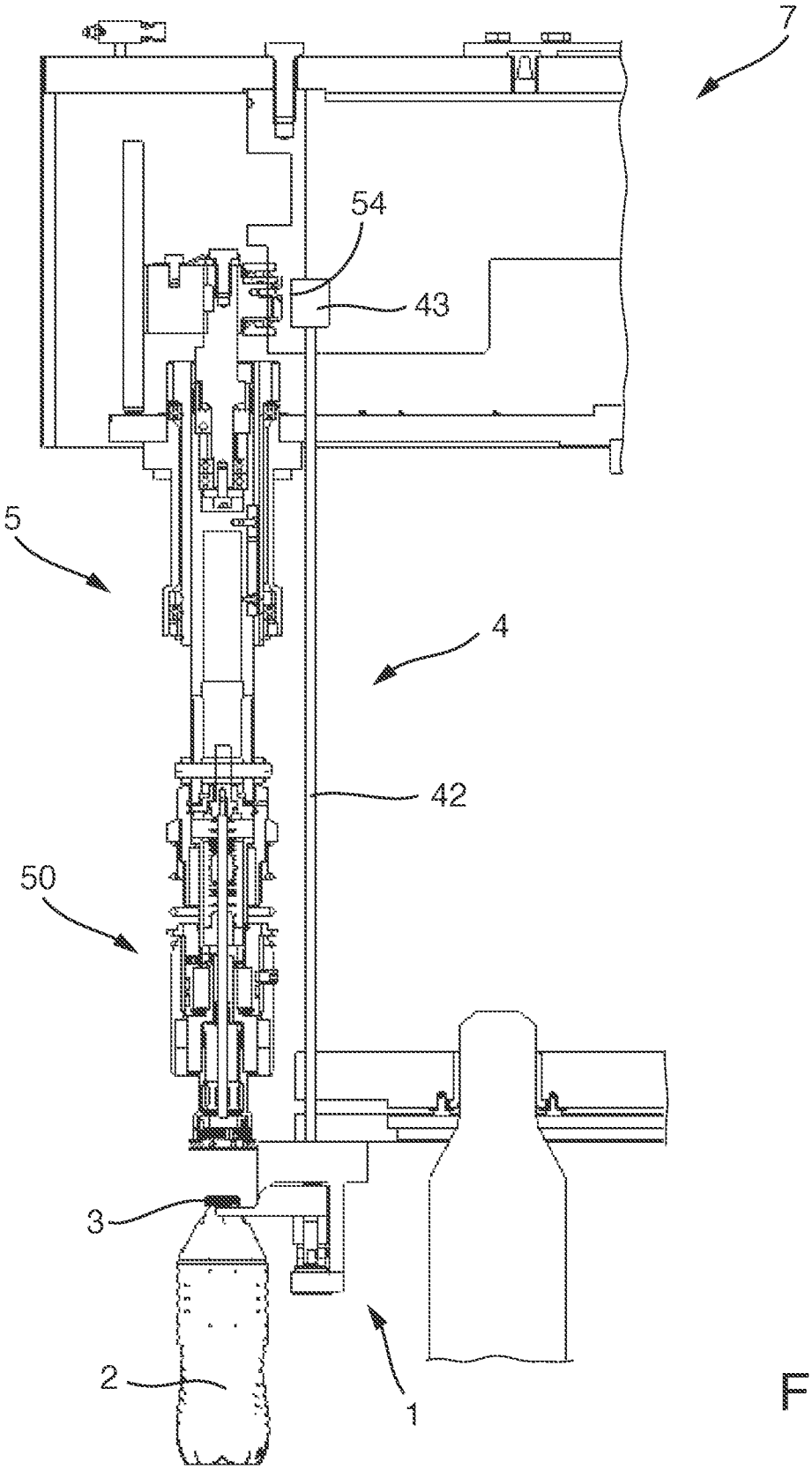
FIG. 12 is a schematic representation of a sectional view of a further closing device for closing a container by way of a container closure.

FIG. 12 shows a schematic representation of a sectional view of a further closing device 5 for closing a container 2 by way of a container closure 3. The closing device 5 corresponds substantially to that shown in FIG. 11, the control unit 4 of the device 1 interacting in this case with a guide groove 54 via a linkage 42 and a guide roller 43.

Figure 13:
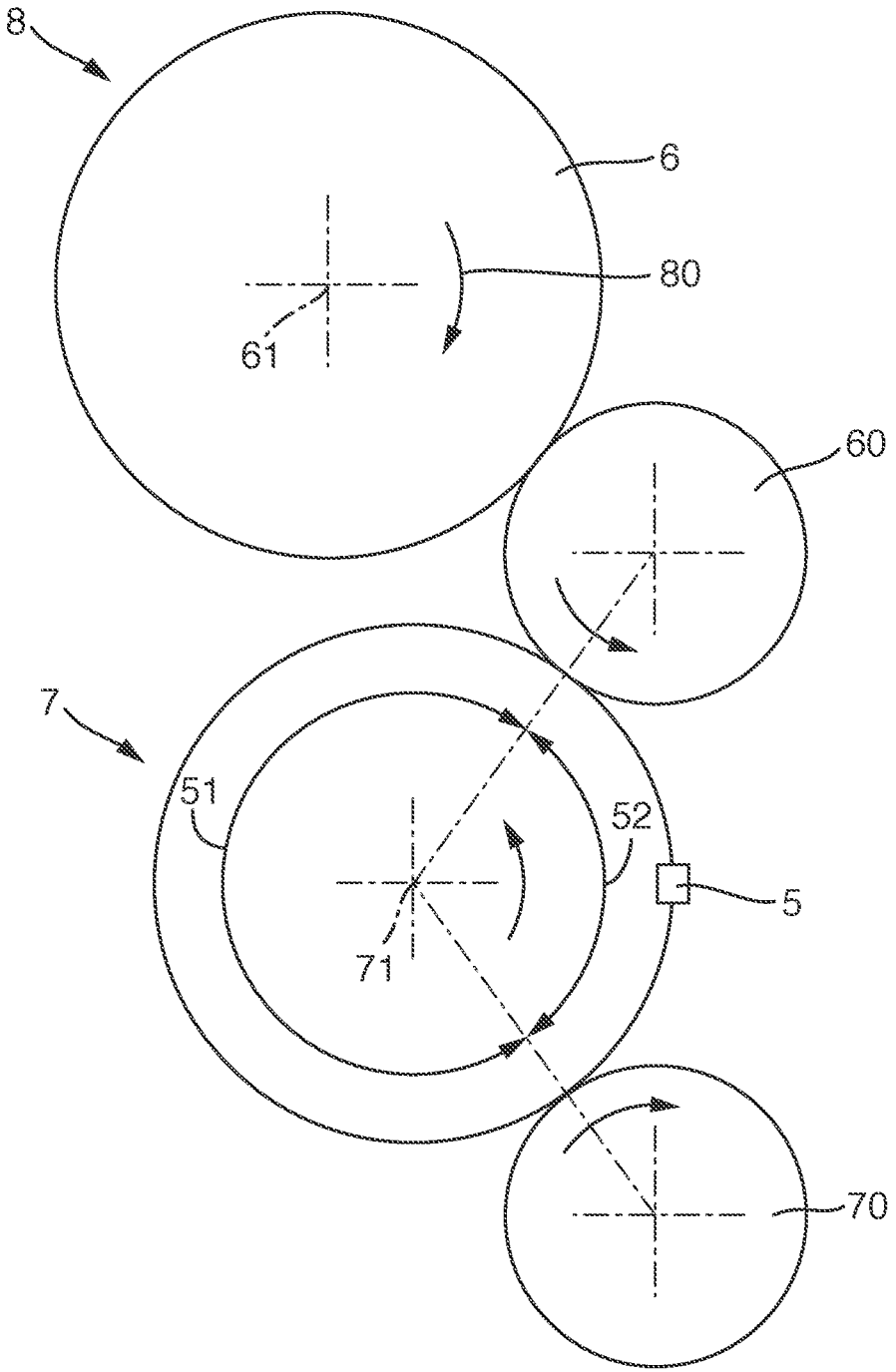
FIG. 13 is a schematic representation of a top view of a beverage filling installation.

FIG. 13 shows a schematic representation of a top view of a beverage filling installation 8 which is set up for filling a still liquid into containers 2 in the form of support-ring-free bottles.

The beverage filling installation 8 includes a filler carousel 6 which is rotatable about a rotational axis 61 and includes a plurality of filling devices (not shown) for filling support-ring-free bottles with the still liquid. When viewed in a transport direction 80, connecting to the filler carousel 6 is a filler outlet star 60, to which the filled containers 2 are transferred. The filler outlet star 60 transports the containers 2 to and transfers them to a capper carousel 7 which is rotatable about a rotational axis 71 and includes a plurality of closing devices 5 according to one of the preceding embodiments, only one of the closing devices 5 being shown schematically here. During the transport of a fill container 2 along the capper carousel 7, it is closed by way of a container closure 3 by means of the closing device 5 assigned thereto and is then transferred to a capper outlet star 70.

The device 1 or rather the holding arms 110, 112, 114 of the device 1 are situated in a second segment 52 in the open position, are closed when the filled containers 2 are transferred to the position of the filler outlet star 60 or are pivoted into the closed position in order to receive and to support or to hold the filled containers 2 there, and remain in the closed position until the filled and closed containers 2 are transferred to the capper outlet star 70. Consequently, the devices 1 are always situated in a first segment 51 in the closed position.

Insofar as applicable, all individual features which are shown in the various embodiments can be combined together and/or exchanged without departing from the scope of the invention.

The invention claimed is:

1. A device for holding a container in a container handling machine comprising:

a carrier; and a holding arrangement arranged on the carrier, wherein:

the holding arrangement is movable relative to the carrier between a closed position for holding the container and an open position for releasing the container, the holding arrangement comprises a collar-shaped support projection configured to support the container on a retaining ring of the container, the collar-shaped support projection comprises a first holding arm with a first support projection region and a second holding arm with a second support projection region, the first holding arm and the second holding arm are configured on the carrier to enable them to pivot in relation to one another for moving between the open position and the closed position, the collar-shaped support projection defines a holding plane, the first holding arm is further configured on the carrier to enable the first holding arm to pivot about a first pivot axis, and the second holding arm is further configured on the carrier to enable the second holding arm to pivot about a second pivot axis, the first pivot axis and the second pivot axis lie in a pivot axis plane that extends parallel to the holding plane, and the first pivot axis and the second pivot axis are arranged parallel to one another.

2. The device of claim 1, wherein the holding plane has a lower height in the open position than in the closed position.

3. The device of claim 1, wherein at least one of the first pivot axis or the second pivot axis lies in a first pivot axis plane.

4. The device of claim 3, wherein the first pivot axis plane is arranged above the holding plane or at a height of the holding plane.

5. The device of claim 1, wherein:

the first support projection region is able to pivot downward and radially outward about the first pivot axis in the open position relative to its position in the closed position, and the second support projection region is able to pivot downward and radially outward about the second pivot axis in the open position relative to its position in the closed position.

6. The device of claim 1, wherein the collar-shaped support projection further comprises at least one tapered mandrel configured to impede a rotation of the container in the first holding arm and the second holding arm about its container axis.

7. The device of claim 6, wherein the at least one tapered mandrel is directed upward in the closed position.

8. The device of claim 1, further comprising a third holding arm, wherein the third holding arm is configured to enable the third holding arm to pivot about a third pivot axis relative to the carrier.

9. The device of claim 8, wherein the third holding arm comprises a third support projection region.

10. The device of claim 8, wherein the third pivot axis lies in a second pivot axis plane.

11. The device of claim 10, wherein the third pivot axis is perpendicular to the first pivot axis and the second pivot axis.

12. The device of claim 1, wherein the collar-shaped support projection exclusively supports the container on a bottom side of the retaining ring of the container.

13. The device of claim 1, further comprising a bearing portion arranged on the carrier that is configured to support the container on a retaining ring or on a tamper-evident band of an applied container closure when the first holding arm and the second holding arm are pivoted to the open position.

14. The device of claim 13, wherein the bearing portion is arranged at a predefined distance below the holding plane, such that when the first holding arm and the second holding arm are in the closed position, the applied container closure is spaced from the bearing portion at a distance of between 0.1 and 2 mm.

15. The device of claim 1, further comprising a control unit configured to control a position of the first holding arm and a position of the second holding arm, wherein the control unit comprises a cam follower and/or a drive.

16. A closing device for closing a filled container via a container closure comprising:

a closing member configured to apply the container closure onto the filled container; and the device of claim 1.

17. A device for holding a container in a container handling machine comprising:

a carrier; and a holding arrangement arranged on the carrier, wherein:

the holding arrangement is movable relative to the carrier between a closed position for holding the container and an open position for releasing the container, the holding arrangement comprises a collar-shaped support projection configured to support the container on a retaining ring of the container, the collar-shaped support projection comprises a first holding arm with a first support projection region and a second holding arm with a second support projection region, the first holding arm and the second holding arm are arranged on the carrier to enable them to pivot in relation to one another for moving between the open position and the closed position, the collar-shaped support projection defines a holding plane, the first holding arm is configured on the carrier to enable the first holding arm to pivot about a first pivot axis, and the second holding arm is configured on the carrier to enable the second holding arm to pivot about a second pivot axis, the first pivot axis and the second pivot axis lie in a pivot axis plane that extends parallel to the holding plane, the first pivot axis and the second pivot axis are arranged parallel to one another, and the collar-shaped support projection extends at a circumferential angle of more than 180°.

18. The device of claim 17, further comprising a third holding arm with a third support projection region.

19. The device of claim 18, wherein:

the third holding arm is arranged on the carrier to pivot about a third pivot axis, and the third pivot axis lies in a second pivot axis plane.

20. The device of claim 19, wherein the third pivot axis is perpendicular to the first pivot axis and the second pivot axis.

* * * * *